US009744651B2

(12) United States Patent
Lai

(10) Patent No.: US 9,744,651 B2
(45) Date of Patent: Aug. 29, 2017

(54) MOVABLE SPANNER STRUCTURE

(71) Applicant: Wei-Ming Lai, Taichung (TW)

(72) Inventor: Wei-Ming Lai, Taichung (TW)

( * ) Notice: Subject to any disclaimer, the term of this patent is extended or adjusted under 35 U.S.C. 154(b) by 241 days.

(21) Appl. No.: 14/797,196

(22) Filed: Jul. 13, 2015

(65) Prior Publication Data

US 2016/0067847 A1 Mar. 10, 2016

(30) Foreign Application Priority Data

Sep. 4, 2014 (TW) ..... 103215778 U

(51) Int. Cl.
*B25B 13/14* (2006.01)
*B25B 13/46* (2006.01)

(52) U.S. Cl.
CPC ..... *B25B 13/46* (2013.01); *B25B 13/14* (2013.01)

(58) Field of Classification Search
CPC ..... B25B 13/12; B25B 13/14; B25B 13/16
See application file for complete search history.

(56) References Cited

U.S. PATENT DOCUMENTS 3,926,077 A * 12/1975 Nordgren ..... B25B 13/14 81/126
5,890,404 A * 4/1999 Stojanowski ..... B25B 13/12 81/158
6,851,338 B2 * 2/2005 Wu ..... B25B 13/14 81/157
8,074,540 B2 * 12/2011 Huang ..... B25B 13/14 81/133
8,136,429 B2 * 3/2012 Wu ..... B25B 13/14 81/165
8,276,484 B2 * 10/2012 Huang ..... B25B 13/14 81/126
8,549,961 B2 * 10/2013 Huang ..... B25B 13/14 81/126
8,794,112 B2 * 8/2014 Yu ..... B25B 13/14 81/126
9,061,402 B2 * 6/2015 Harvey ..... B25B 13/14 81/126
9,162,347 B2 * 10/2015 Huang ..... B25B 13/14 81/126
9,193,044 B2 * 11/2015 Cheng ..... B25B 13/14 81/165
2015/0101460 A1 * 4/2015 Wu ..... B25B 13/14 81/165

* cited by examiner

*Primary Examiner* — David B Thomas

(57) ABSTRACT

A movable spanner structure contains: a first body, a second body, an adjustable bolt, a first coupling element, a locking member, a third body, and a second coupling element. The first body includes a first retainer, an accommodating groove, a quadrangle trench, a first orifice, a first cavity, a first connecting portion, and a second cavity. The second body includes a second retainer, a slidable extension, and a first toothed portion. The adjustable bolt includes a second toothed portion and a second orifice. The first coupling element is fixed in the first orifice. The locking member includes an abutting portion, a third orifice, and a first pressing portion. The third body includes a second connecting portion and a second pressing portion. The second coupling element is mounted in the first connecting portion and the second connecting portion, such that the third body is rotatably coupled with the first body.

18 Claims, 13 Drawing Sheets

MOVABLE SPANNER STRUCTURE

FIELD OF THE INVENTION

The present invention relates to a movable spanner structure which contains a locking member and a third body, wherein when the third body rotates counterclockwise, the locking member is not pressed by the third body, and an adjustable bolt moves to obtain ratchet effect.

BACKGROUND OF THE INVENTION

A conventional movable spanner is disclosed in U.S. Pat. No. 6,568,301 B2 and contains a body 1, a sliding block 2, a movable jaw 3, and a handle 4. The body 1 has a fixed jaw 11 disposed on a first end thereof and has a groove 12 defined therein to accommodate the movable jaw 3, and a second end of the body 1 is rotatably connected with the handle 4, wherein the body 1 also includes a hollow portion 13 passing therethrough to receive the sliding block 2, characterized in that: a bottom and a top of the sliding block 2 are limited by the hollow portion 13, such that the siding block 2 slides horizontally in the hollow portion 13. The sliding block 2 is rotatably with an adjustable bolt 21, and the movable jaw 3 has a toothed portion 32 corresponding to the adjustable bolt 21, such that the adjustable bolt 21 is rotated to move the movable jaw 3. The sliding block 2 also includes a recessed portion 22 defined on one side thereof proximate to the handle 4, and the handle 4 at least includes a first stopper 41 and a second stopper 42 which correspond to the recessed portion 22. Among the first stopper 41, the second stopper 42, and the hollow portion 13 are defined a first resilient element 23 and a second resilient element 24, such that the first resilient element 23 and the second resilient element 24 push the first stopper 41 and the second stopper 42, and then the first stopper 41 and the second stopper 42 push the sliding block 2 toward the fixed jaw 11.

However, the conventional movable spanner still has defects as follows:

1. After the handle 4 is rotated to exert a force onto the first stopper 41, the first stopper 41 forces the sliding block 2 and the adjustable bolt 21 so as to rotate the movable jaw 3, such that a screwing element 5 is rotated by the movable jaw 3. Due to the first stopper 41 forces the sliding block 2, the hollow portion 13 of the body 1 accommodates the sliding block 2 and the adjustable bolt 21, and the first stopper 41 is limited by the hollow portion 12, so a cross-sectional area of the first stopper 41 is limited, and the first stopper 41 is broken easily.

2. The handle 4 has an extension, a first plate 401, a second plate 402, and plural joining bolts, thus manufacturing the handle 4 at high cost.

The present invention has arisen to mitigate and/or obviate the afore-described disadvantages.

SUMMARY OF THE INVENTION

The primary objective of the present invention is to provide a movable spanner structure which contains a locking member and a third body, wherein the locking member forces an adjustable bolt, and when the third body rotates counterclockwise, the locking member is not pressed by the third body so that the adjustable bolt moves to obtain ratchet effect.

To obtain the above objective, a movable spanner structure provided by the present invention contains: a first body, a second body, an adjustable bolt, a first coupling element, a locking member, a third body, and a second coupling element.

The first body includes a first retainer extending outwardly from one end thereof, an accommodating groove proximate to the first retainer, and a quadrangle trench defined thereon and communicating with the accommodating groove, wherein the quadrangle trench has a first face and a second face which are formed on two sides of the quadrangle trench, and between the first face and the second face is defined a first distance, the first body also includes a first orifice communicating with the quadrangle trench, and the first body includes a first cavity away from the first retainer, wherein a top surface and a bottom surface of the first cavity are closed, the one end of the first body away from the first retainer is open by ways of the first cavity, wherein the first cavity has a third face defined on the bottom surface thereof. The first body further includes a first connecting portion passing therethrough and communicating with the first cavity and includes a second cavity communicating with the first cavity and the quadrangle trench.

The second body includes a second retainer extending outwardly from one end thereof and corresponding to the first retainer of the body, the second body also includes a slidable extension disposed thereon and accommodated in the accommodating groove, such that the second body moves straightly in the accommodating groove of the first body, wherein the slidable extension has a first toothed portion arranged thereon.

The adjustable bolt is fixed in the quadrangle trench of the first body, wherein a length of the adjustable bolt is less than the first distance, and the adjustable bolt includes a second toothed portion formed on an outer side thereof to engage with the first toothed portion of the second body, such that after the adjustable bolt is rotated, it drives the second body to move straightly in the accommodating groove of the first body, and the adjustable bolt also includes a second orifice aligning with the first orifice of the body.

The first coupling element is fixed in the first orifice of the first body and the second orifice of the adjustable bolt, such that the adjustable bolt is rotatably connected with the quadrangle trench.

The locking member is accommodated in the second cavity of the first body and includes an abutting portion extending outwardly from a first end thereof and mounted in the second cavity, wherein the abutting portion contacts with a first end of the adjustable bolt and has a third orifice passing therethrough and aligning with the first orifice and the second orifice so that the third orifice fits with the first coupling element, and the locking member further includes a first pressing portion.

The third body is disposed in the first cavity of the first body and includes a second connecting portion aligning with the first connecting portion of the first body, and the third body also includes a second pressing portion abutting against the first pressing portion of the locking member.

The second coupling element is mounted in the first connecting portion of the first body and the second connecting portion of the third body, such that the third body is rotatably coupled with the first body.

DETAILED DESCRIPTION OF THE FIRST EMBODIMENTS

Figure 1:
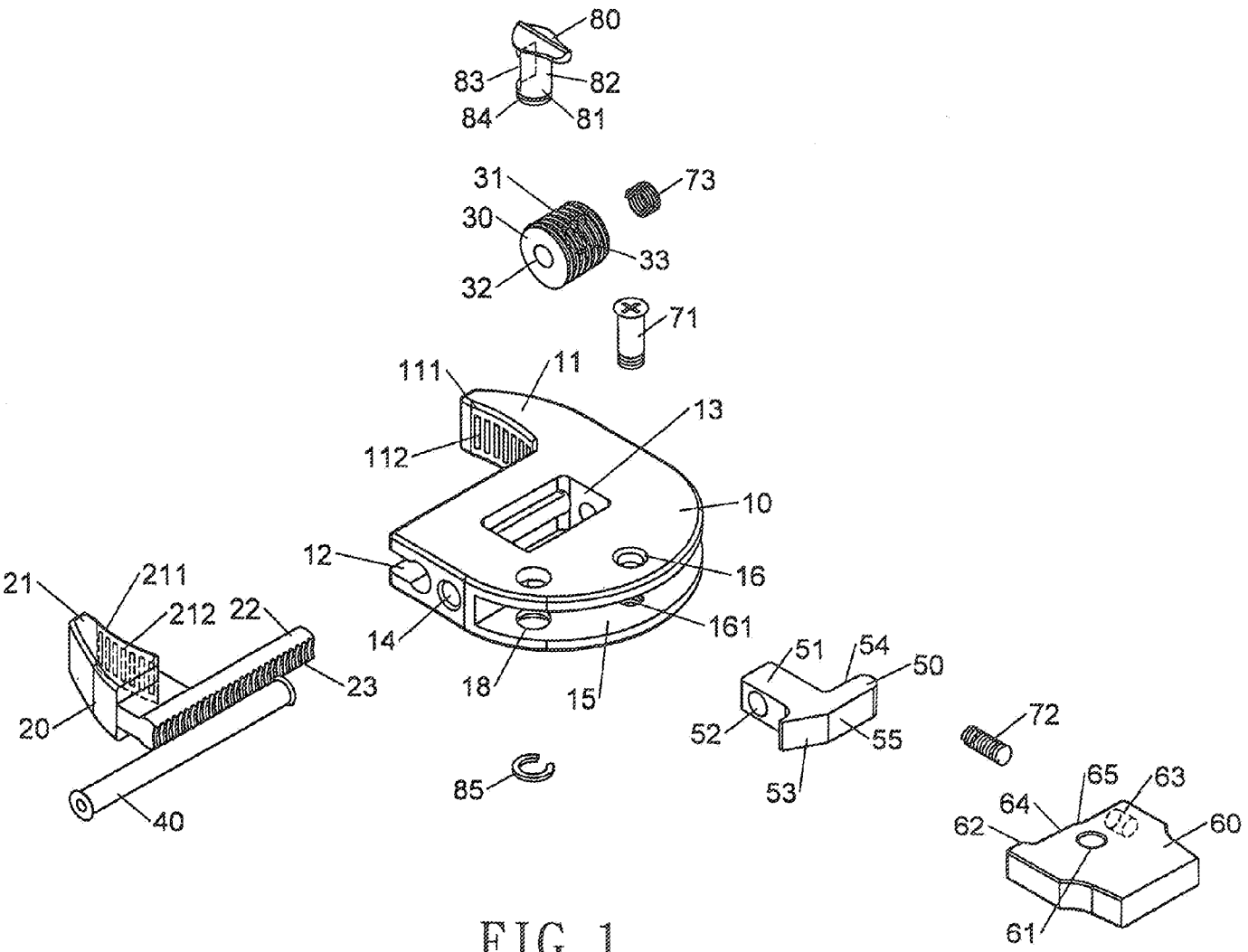
FIG. 1 is a perspective view showing the exploded components of a movable spanner structure according to a first embodiment of the present invention.
Figure 3:
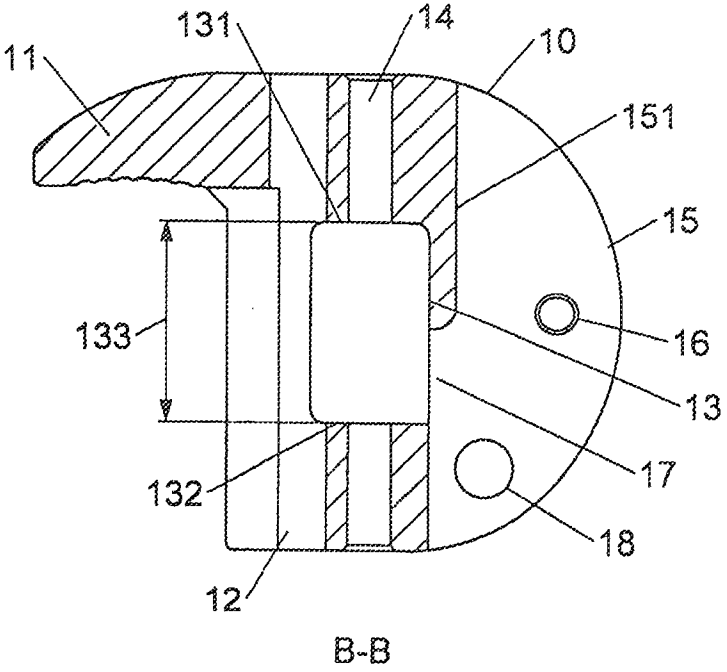
FIG. 3 is a cross sectional view taken along the line B-B of FIG. 2.
Figure 2:
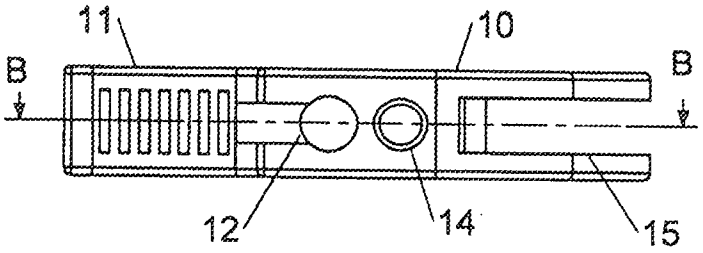
FIG. 2 is a side plan view showing the assembly of a part of the movable spanner structure according to the first embodiment of the present invention.

With reference to FIGS. 1 to 3, FIG. 1 is a perspective view showing the exploded components of a movable spanner structure according to a first embodiment of the present invention. FIG. 2 is a side plan view showing the assembly of a part of the movable spanner structure according to the first embodiment of the present invention. FIG. 3 is a cross sectional view taken along the line B-B of FIG. 2. The movable spanner structure according to the first embodiment of the present invention comprises: a first body 10 (as shown in FIGS. 2 and 3), wherein the first body 10 includes a first retainer 11 extending outwardly from one end thereof, and the first retainer 11 has a first retaining face 111 formed in a concave arc shape and has a plurality of first longitudinal ribs 112 parallelly arranged thereon. The first body 10 also includes an accommodating groove 12 proximate to the first retainer 11, wherein the accommodating groove 12 has a square opening defined on a front end thereof adjacent to the first retainer 11 and has a circular space formed on a rear end thereof away from the square opening. The first body 10 further includes a quadrangle trench 13 defined thereon and communicating with the accommodating groove 12, wherein the quadrangle trench 13 has a first face 131 and a second face 132 which are formed on two sides of the quadrangle trench 13, and between the first face 131 and the second face 132 is defined a first distance 133. The first body 10 further includes a first orifice 14 arranged on a central portion thereof and communicating with the quadrangle trench 13, and the first body 10 includes a first cavity 15 away from the first retainer 11, wherein a top surface and a bottom surface of the first cavity 15 are closed, and the one end of the first body 10 away from the first retainer 11 is open by ways of the first cavity 15, wherein the first cavity 15 has a third face 151 defined on the bottom surface thereof and being a flat surface. The first body 10 further includes a first connecting portion 16 passing therethrough and communicating with the first cavity 15, and the first connecting portion 16 has a threaded orifice 161 formed on one end thereof. The first body 10 further includes a second cavity 17 communicating with the first cavity 15 and the quadrangle trench 13, and the first body 10 also includes a through hole 18 passing therethrough and located adjacent to a connection area of the first cavity 15 and the second cavity 17.

The movable spanner structure also comprises: a second body 20, wherein the second body 20 includes a second retainer 21 extending outwardly from one end thereof and corresponding to the first retainer 11 of the body 10, and the second retainer 21 has a second retaining face 211 formed in a concave arc shape and has a plurality of second longitudinal ribs 212 parallelly arranged thereon and corresponding to the plurality of first longitudinal ribs 112. The second body 20 also includes: a slidable extension 22 disposed thereon and accommodated in the accommodating groove 12, such that the second body 20 moves straightly in the accommodating groove 12 of the first body 10, wherein the slidable extension 22 is formed in a rod shape and has a first toothed portion 23 arranged thereon.

The movable spanner structure also comprises: an adjustable bolt 30 fixed in the quadrangle trench 13 of the first body 10, wherein a length of the adjustable bolt 30 is less than the first distance 133, and the adjustable bolt 30 includes a second toothed portion 31 formed on an outer side thereof to engage with the first toothed portion 23 of the second body 20, such that after the adjustable bolt 30 is rotated, it drives the second body 20 to move straightly in the accommodating groove 12 of the first body 10, and the adjustable bolt 30 also includes a second orifice 32 defined on a central portion thereof and aligning with the first orifice 14 of the body 10, the adjustable bolt 30 also includes a first receiving slot 33 defined on a first end thereof and aligning with the first face 131, wherein the adjustable bolt 30 is columnar.

The movable spanner structure also comprises: a first coupling element 40 fixed in the first orifice 14 of the first body 10 and the second orifice 32 of the adjustable bolt 30, such that the adjustable bolt 30 is rotatably connected with the quadrangle trench 13.

The movable spanner structure also comprises: a locking member 50 formed in an L shape and accommodated in the first cavity 15 and the second cavity 17 of the first body 10, the locking member 50 includes an abutting portion 51 extending outwardly from a first end thereof and mounted in the second cavity 17, wherein the abutting portion 51 contacts with the first end of the adjustable bolt 30 and extends into the quadrangle trench 13, and the first distance 133 is greater than a total length of the adjustable bolt 30 and the abutting portion 51, the abutting portion 51 has a third orifice 52 passing therethrough and aligning with the first orifice 14 and the second orifice 32 so that the third orifice 52 fits with the first coupling element 40. The locking member 50 further includes a first pressing portion 53 which is a tilted surface, a fourth face 54 arranged on the first end thereof, and a fifth face 55 formed on a second end thereof; wherein the fourth face 54 and the fifth face 55 are accommodated in the first cavity 15, and the fourth face 54 contacts with the third face 151, wherein the fourth face 52 is flat or arcuate, and the fifth face 55 is flat; wherein when the fourth face 52 is flat, it is parallel to the fifth face 55 and the third face 151.

The movable spanner structure also comprises: a third body 60 disposed in the first cavity 15 of the first body 10, and the third body 60 includes a second connecting portion 61 formed on a central portion thereof and aligning with the first connecting portion 16 of the first body 10, a second pressing portion 62 abutting against the first pressing portion 53 of the locking member 50, wherein the second pressing portion 62 is formed in a convex arc shape. The third body 60 also includes a second receiving slot 63 defined therein away from the second pressing portion 62 and facing to the third face 151, wherein the second receiving slot 63 is circular. The third body 60 further includes a sixth face 64 proximate to the second pressing portion 63 and contacting with the fifth face 55 of the locking member 50, wherein the sixth face 64 is flat or arcuate, and the sixth face 64 has an arcuate section 65 away from the second pressing portion 62. Preferably, the third body 60 is a handle to be manually grasped by a user.

The movable spanner structure also comprises: a second coupling element 71 mounted in the first connecting portion 16 of the first body 10 and the second connecting portion 61 of the third body 60, such that the third body 60 is rotatably coupled with the first body 10, wherein the second coupling element 71 has a screwing portion for screwing with the threaded orifice 161; a first resilient element 72 accommodated in the second cavity 63 of the third body 60 and pushing against the third face 151 of the first cavity 15; a second resilient element 73 fixed in the first cavity 33 of the adjustable bolt 30 and abutting against the adjustable bolt 30 and the first face 131 of the quadrangle trench 13; a control member 80 rotatably joined with the through hole 18 of the first body 10 and including a rotating portion formed on a first end thereof and extending out of the first body 10, wherein the control member 80 includes a controlling portion 81 formed on a column shape, and the controlling portion 81 has an outer fence 82 and a driving notch 83, wherein the outer fence 82 contacts with the third body 60, such that the third body 60 does not rotate relative to the first body 10, and after rotating the control member 80, the driving notch 83 aligns with the third body 60 to define a rotating space in the third body 60. The control member 80 also includes a fastening notch 84 defined on a second end thereof and includes a retaining ring 85 disposed in the fastening notch 84 of the control member 80, such that the control member 80 is mounted in the through hole 18 by the retaining ring 85, wherein the retaining ring 85 is formed in a C shape.

Figure 4:
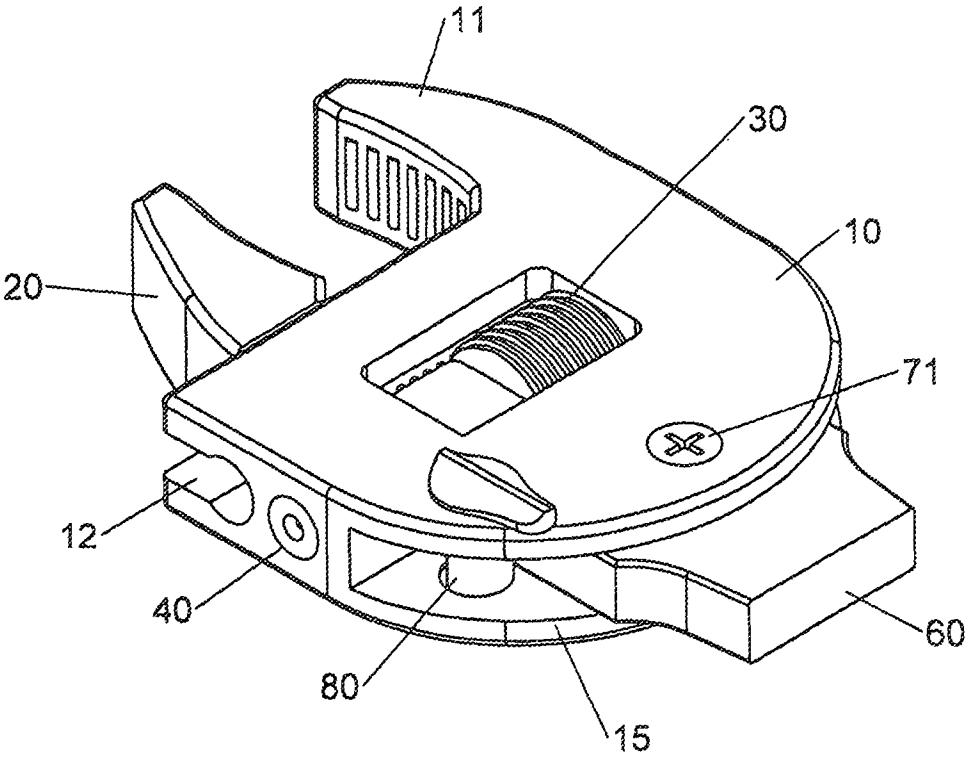
FIG. 4 is a perspective view showing the assembly of the movable spanner structure according to the first embodiment of the present invention.

FIG. 4 is a perspective view showing the assembly of the movable spanner structure according to the first embodiment of the present invention. With reference to FIG. 4, the second body 20 is secured in the accommodating groove 12 of the first body 10, and the first retainer 11 of the body 10 corresponds to the second retainer 21 of the second body 20, wherein the first retainer 11 and the second retainer 21 clamp an object (not shown) securely by using the plurality of first longitudinal ribs 112 and the plurality of second longitudinal ribs 212, and the adjustable bolt 30 is fixed in the quadrangle trench 13 of the first body 10, the first coupling element 40 is inserted through the first orifice 14 of the first body 10 to rotatably connect with the second orifice 32 of the adjustable bolt 30, the locking member 50 is accommodated in the first cavity 15 and the second cavity 17, and the third body 60 is disposed in the first cavity 15 of the first body 10, the second coupling element 71 is mounted in the first connecting portion 16 and the second connecting portion 61 and is screwed with the threaded orifice 161, such that the second coupling element 71 connects the first body 10 and the third body 60 together. The control member 80 is rotatably joined with the through hole 18 of the first body 10 and includes the rotating portion formed on the first end thereof and extending out of the first body 10 to be rotated by the user, and the control member 80 is mounted in the through hole 18 of the first body 10 by the retaining ring 85.

Figure 5:
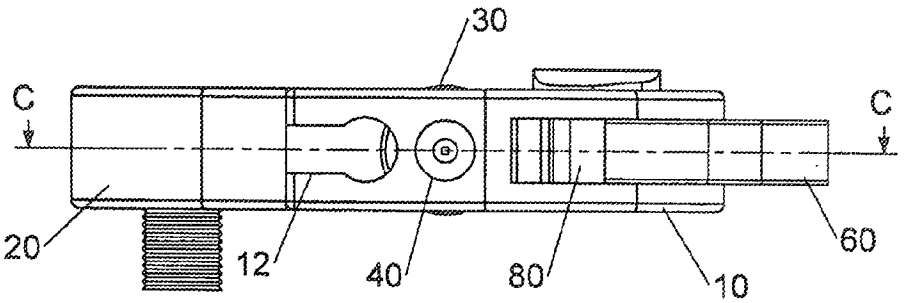
FIG. 5 is a side plan view showing the assembly of the movable spanner structure according to the first embodiment of the present invention.
Figure 6:
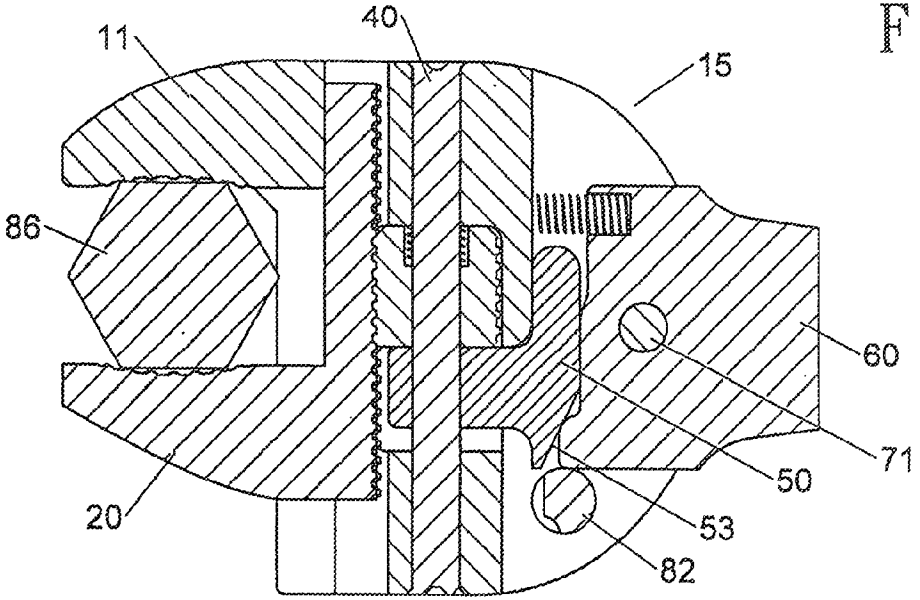
FIG. 6 is a cross sectional view taken along the line C-C of FIG. 5.

FIG. 5 is a side plan view showing the assembly of the movable spanner structure according to the first embodiment of the present invention. FIG. 6 is a cross sectional view taken along the line C-C of FIG. 5. The slidable extension 22 of the second body 20 is accommodated in the accommodating groove 12 of the first body 10, and the first retainer 11 corresponds to the second retainer 21 of the second body 20, the adjustable bolt 30 is fixed in the quadrangle trench 13 so that the second toothed portion 31 of the adjustable bolt 30 engages with the first toothed portion 23 of the second body 20. The first coupling element 40 is inserted through the first orifice 14 to rotatably connect with the second orifice 32, and the locking member 50 is accommodated in the first cavity 15 and the second cavity 17, the abutting portion 51 of the locking member 50 contacts with the adjustable bolt 30, the third orifice 52 of the locking member 50 aligns with the first orifice 14 and the second orifice 32, such that the first coupling element 40 connects the first body 10, the adjustable bolt 30, and the locking member 50 together. In addition, the fourth face 54 of the locking member 50 contacts with the third face 151 of the first cavity 15, the third body 60 is disposed in the first cavity 15 of the first body 10, the second pressing portion 62 of the third body 60 abuts against the first pressing portion 53 of the locking member 50, the sixth face 64 of the third body 60 contacts with the fifth face 55 of the locking member 50, and the second coupling element 71 is mounted in the first connecting portion 16 and the second connecting portion 61 and is screwed with the threaded orifice 161, such that the second coupling element 71 connects the first body 10 and the third body 60 together. The first resilient element 72 is accommodated in the second cavity 63 and pushes against the third face 151, the second resilient element 73 is fixed in the first cavity 33 and is biased against the first face 131, and the control member 80 is rotatably joined with the through hole 18 and its outer fence 82 contacts with the third body 60, such that the first retainer 11 and the second retainer 21 clamp a screwing element 86.

After rotating the third body 60, the second pressing portion 62 of the third body 60 abuts against the first pressing portion 53 of the locking member 50, such that the abutting portion 51 of the locking member 50 contacts with the adjustable bolt 30, the second toothed portion 31 of the adjustable bolt 30 engages with the first toothed portion 23 of the second body 20, and the adjustable bolt 30 is pressed by the locking member 50 to drive the second retainer 21 and the first retainer 11 to clamp the screwing element 86, thus rotating the screwing element 86 clockwise and counterclockwise by ways of the second retainer 21 and the first retainer 11.

Figure 7:
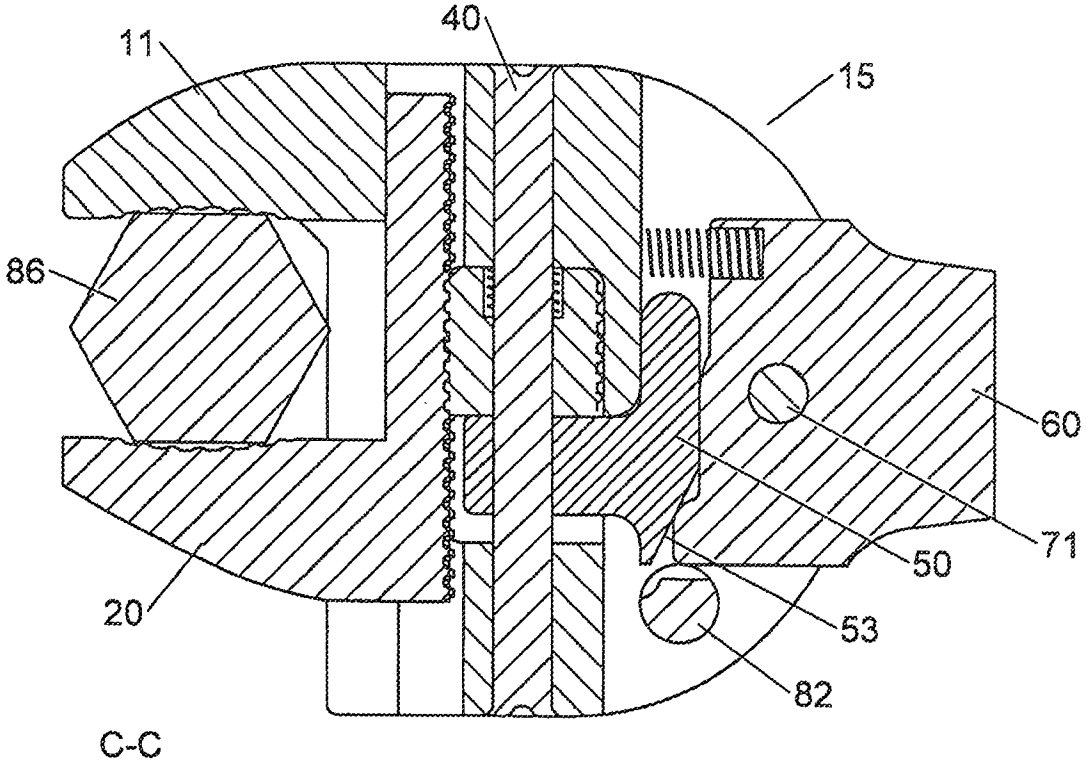
FIG. 7 is a cross sectional view showing the movable spanner structure being rotated clockwise according to the first embodiment of the present invention.

FIG. 7 is a cross sectional view showing the movable spanner structure being rotated clockwise according to the first embodiment of the present invention. Referring to FIG.

7, after the third body 60 is revolved clockwise to align with the driving notch 83, the rotating space is defined in the third body 60, and after continuously rotating the third body 60 clockwise, the second pressing portion 62 of the third body 60 abuts against the first pressing portion 53 of the locking member 50, hence the abutting portion 51 of the locking member 50 contacts with the adjustable bolt 30, the second toothed portion 31 of the adjustable bolt 30 engages with the first toothed portion 23 of the second body 20, and the adjustable bolt 30 drives the second retainer 21 to clamp the screwing element 86, thus rotating the screwing element 86 clockwise.

Figure 8:
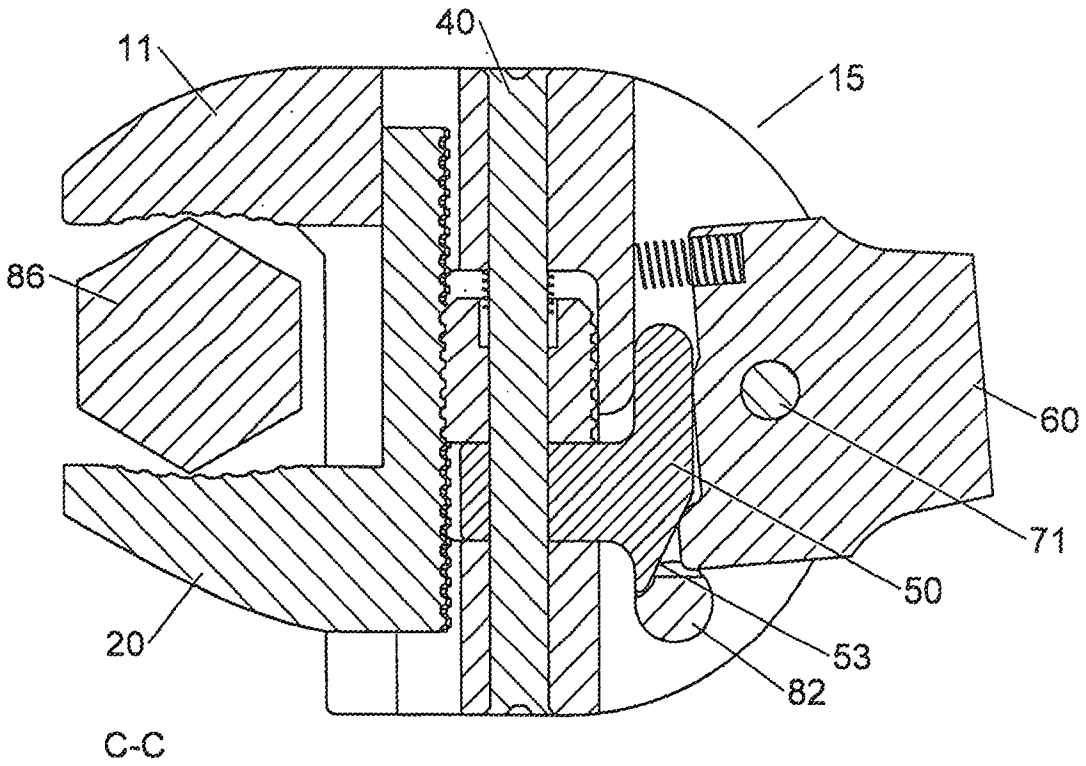
FIG. 8 is a cross sectional view showing the movable spanner structure being rotated counterclockwise according to the first embodiment of the present invention.

FIG. 8 is a cross sectional view showing the movable spanner structure being rotated counterclockwise according to the first embodiment of the present invention. As shown in FIG. 8, after the driving notch 83 is in alignment with the third body 60, the third body 60 is revolved counterclockwise, and the adjustable bolt 30 is pushed by the second body 20 and the second resilient element 73 to move, such that a distance between the first retainer 11 of the first body 10 and the second retainer 21 of the second body 20 increases, and the third body 60 does not rotate the screwing element 86 anymore.

Figure 9:
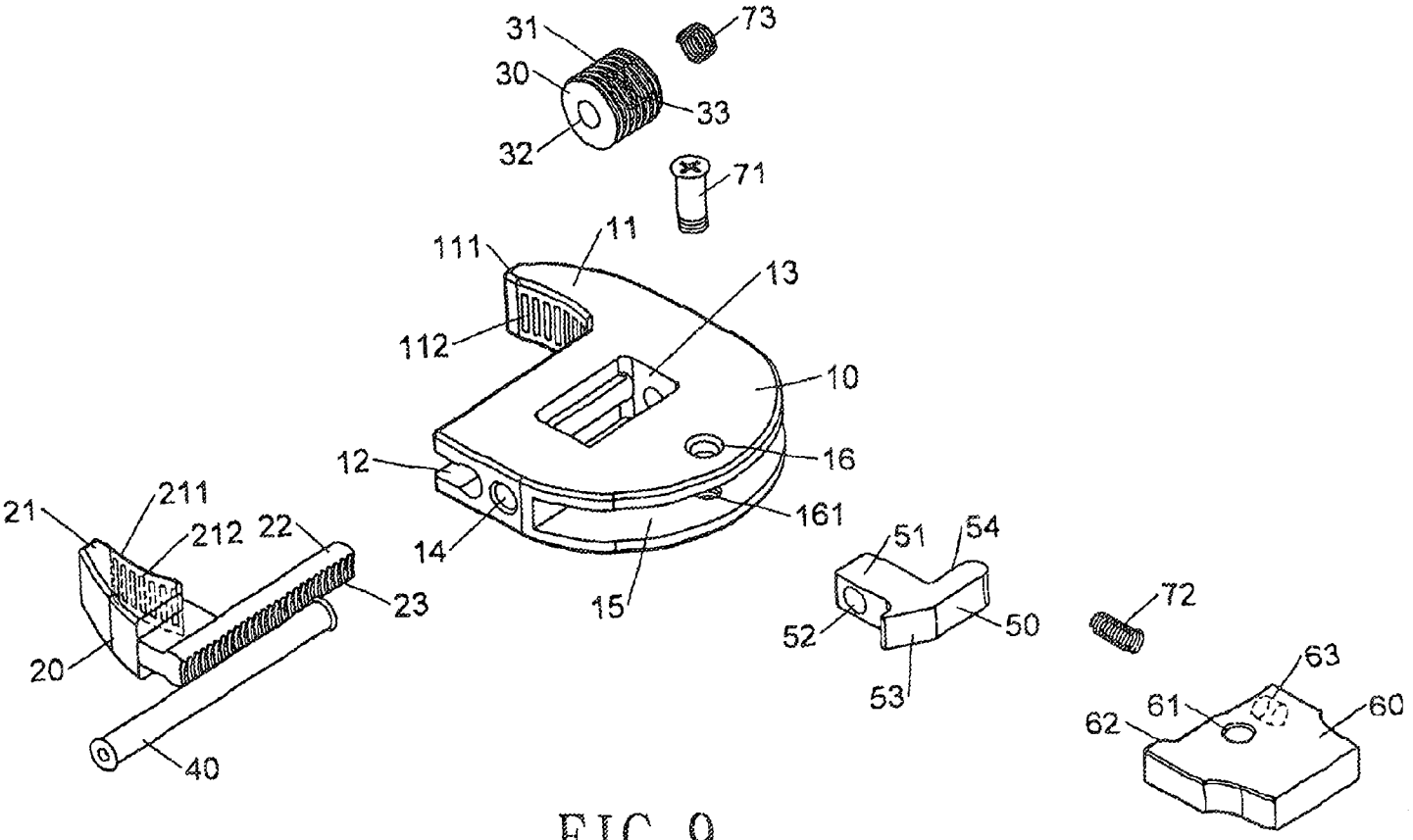
FIG. 9 is a perspective view showing the exploded components of a movable spanner structure according to a second embodiment of the present invention.

FIG. 9 is a perspective view showing the exploded components of a movable spanner structure according to a second embodiment of the present invention, wherein the movable spanner structure of the second embodiment does not comprise the through hole 18, the control member 80, and the retaining ring 85 of the first embodiment.

Figure 10:
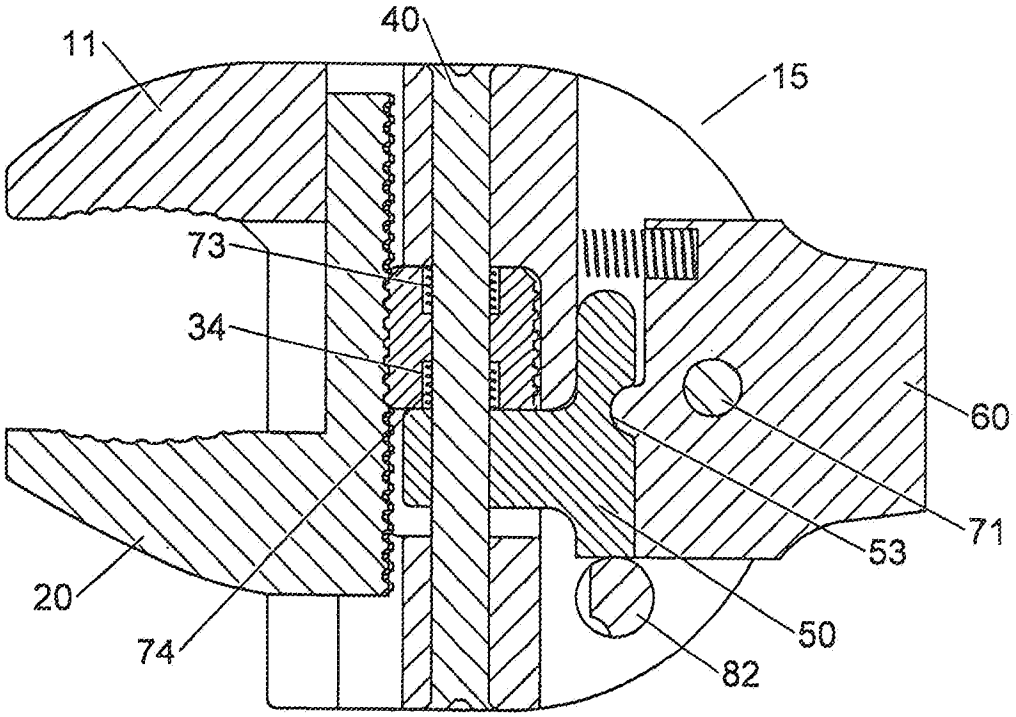
FIG. 10 is a cross sectional view showing the assembly of the movable spanner structure according to a third embodiment of the present invention.

FIG. 10 is a cross sectional view showing the assembly of the movable spanner structure according to a third embodiment of the present invention. The movable spanner structure of the third embodiment comprises a third receiving slot 34 defined on a second end of the adjustable bolt 30 to accommodate a third resilient element 74, and the third resilient element 74 abuts against the abutting portion 51 of the locking member 50, wherein the third resilient element 74 is a spring. In addition, the first pressing portion 53 of the locking member 50 of the third embodiment is formed in a concave arc shape, and the second pressing portion 62 of the third body 60 is formed in a convex arc shape, wherein the second pressing portion 62 is secured in the first pressing portion 53, such that when the third body 60 rotates counterclockwise, it drives the locking member 60 to move, thus obtaining ratchet effect.

Figure 11:
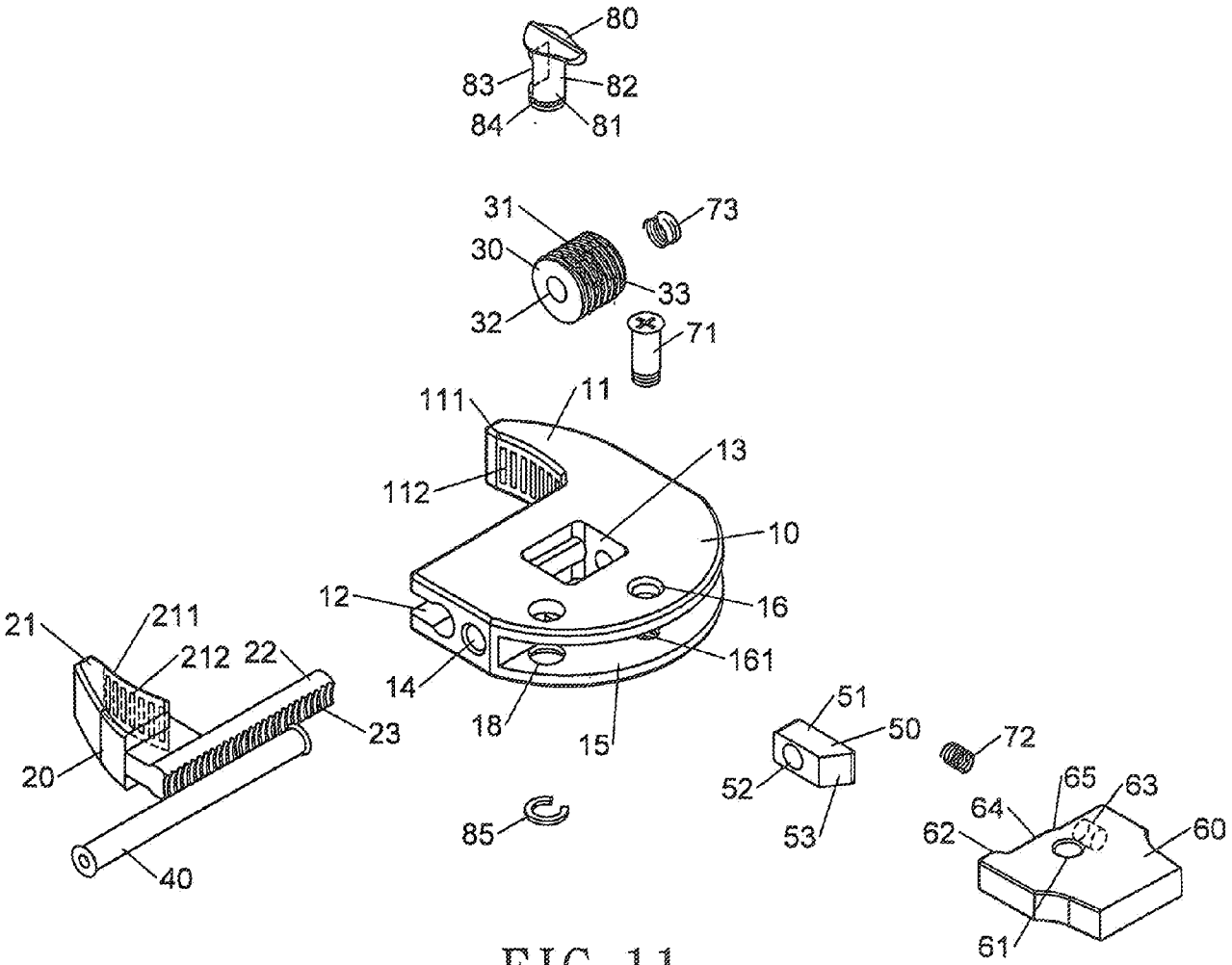
FIG. 11 is a perspective view showing the exploded components of a movable spanner structure according to a fourth embodiment of the present invention.
Figure 12:
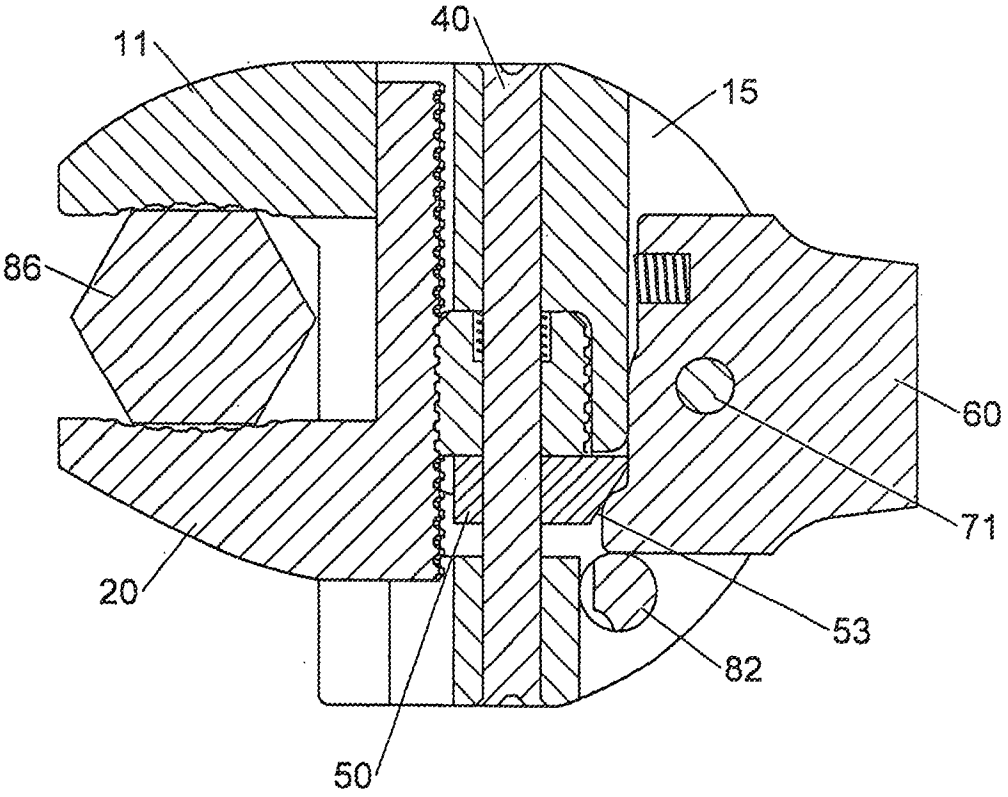
FIG. 12 is a cross sectional view showing the assembly of the movable spanner structure according to the fourth embodiment of the present invention.

FIG. 11 is a perspective view showing the exploded components of a movable spanner structure according to a fourth embodiment of the present invention. FIG. 12 is a cross sectional view showing the assembly of the movable spanner structure according to the fourth embodiment of the present invention. In this embodiment, the locking member 50 is accommodated in the second cavity 17 of the first body 10 and is a trapezoidal protrusion, wherein the locking member 50 does not includes the fourth face 54 and the fifth face 55 of the first embodiment, and the sixth face 64 of the fourth embodiment is biased against the third face 151.

Figure 13:
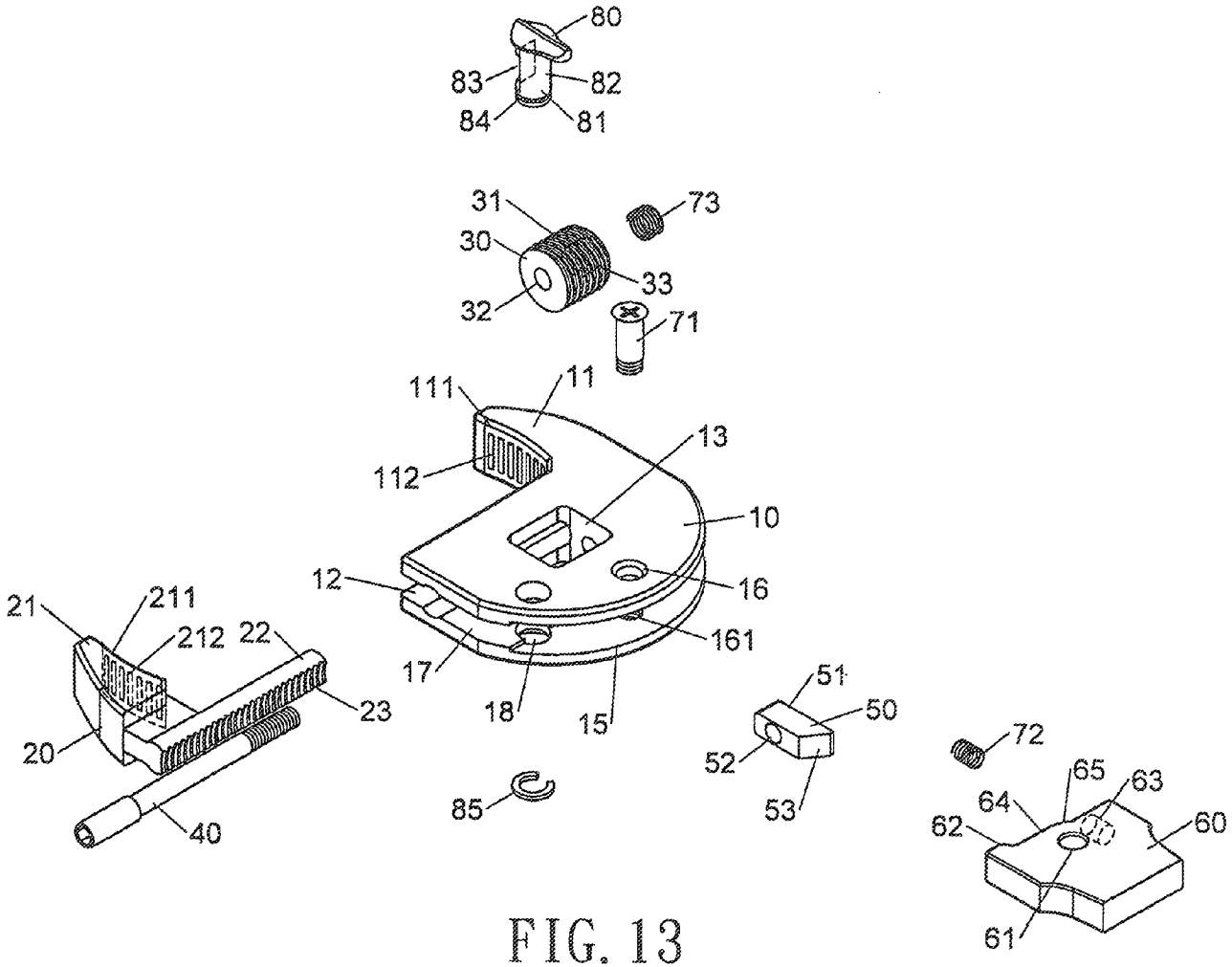
FIG. 13 is a perspective view showing the exploded components of a movable spanner structure according to a fifth embodiment of the present invention.
Figure 14:
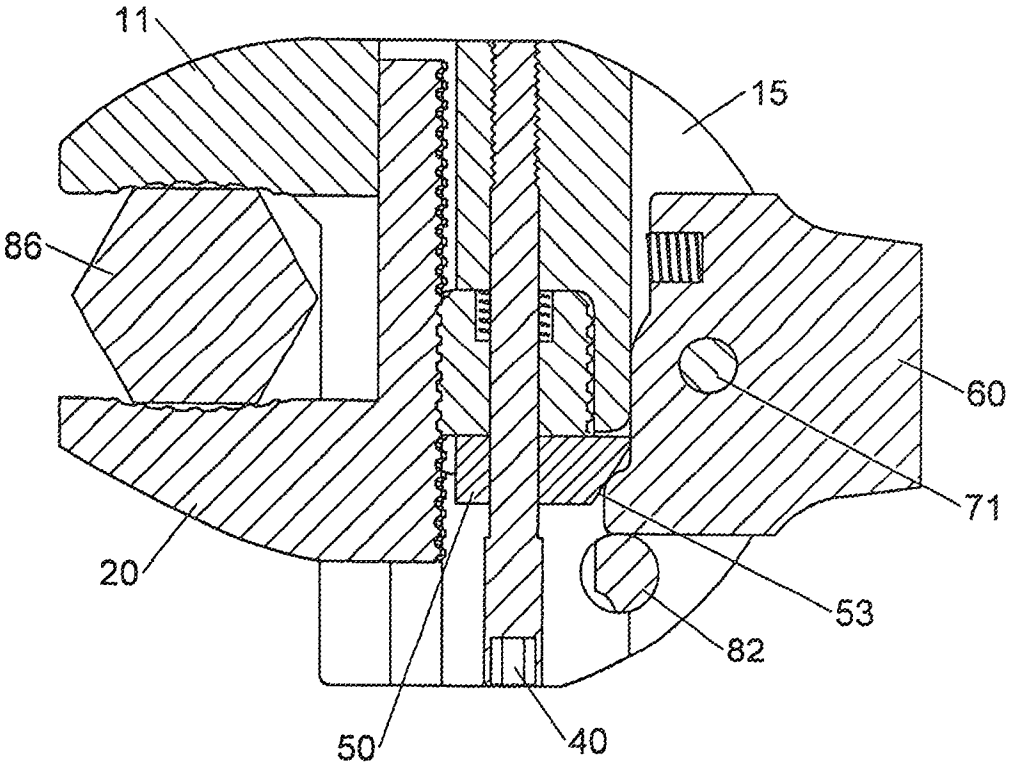
FIG. 14 is a cross sectional view showing the assembly of the movable spanner structure according to the fifth embodiment of the present invention.

FIG. 13 is a perspective view showing the exploded components of a movable spanner structure according to a fifth embodiment of the present invention. FIG. 14 is a cross sectional view showing the assembly of the movable spanner structure according to the fifth embodiment of the present invention. The movable spanner structure of the fifth embodiment comprises a first orifice 14 of a first body 10, and the first orifice 14 has inner threads arranged on an inner wall thereof The movable spanner structure of the fifth embodiment also comprises a first coupling element 40, and the first coupling element 40 has outer threads arranged on an edge thereof to screw with the inner threads of the first orifice 14.

Figure 15:
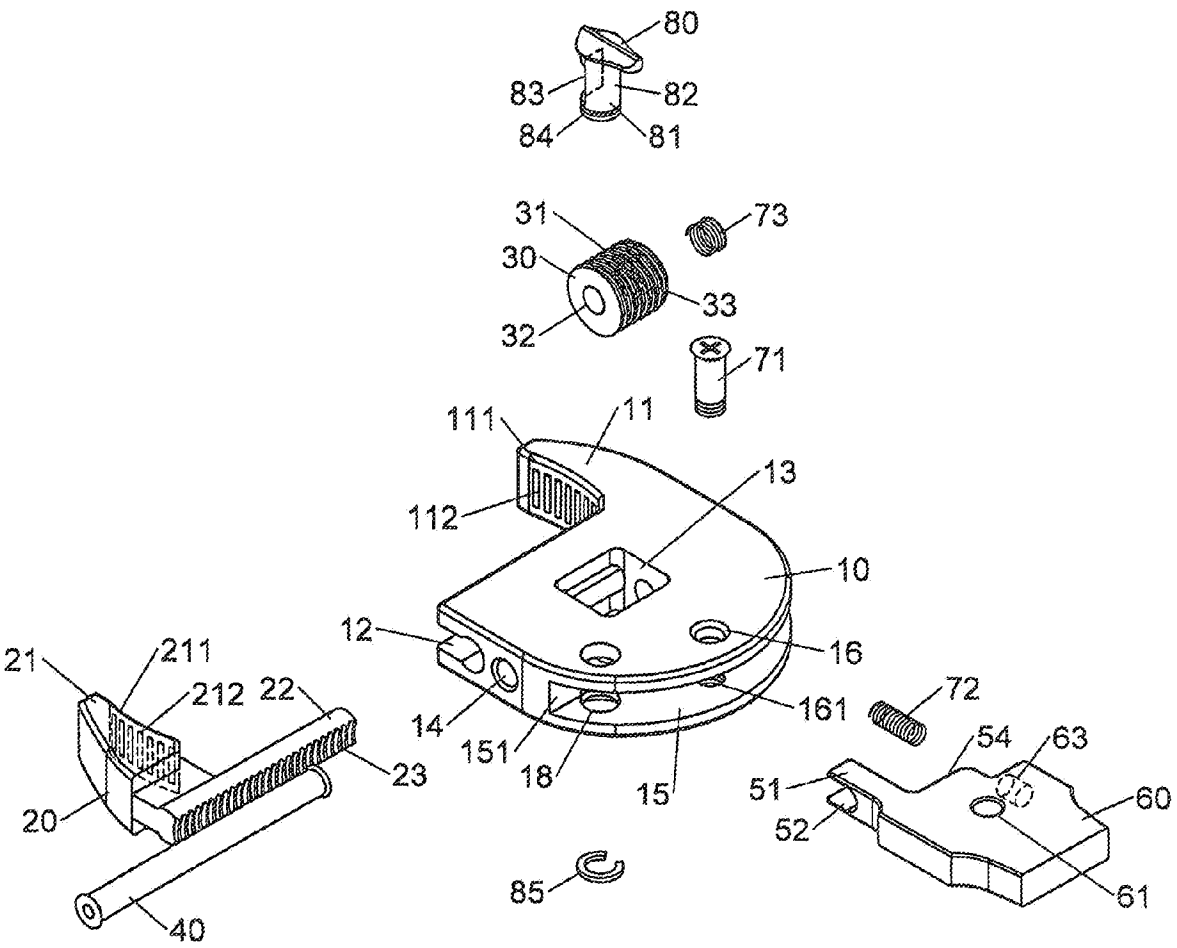
FIG. 15 is a perspective view showing the exploded components of a movable spanner structure according to a sixth embodiment of the present invention.

FIG. 15 is a perspective view showing the exploded components of a movable spanner structure according to a sixth embodiment of the present invention, wherein a locking member 50 and a third body 60 of the sixth embodiment are one piece formed to save production cost.

Thereby, the movable spanner structure of the present invention has advantages as follows:

1. As shown in FIGS. 6 and 7, when the third body 60 rotates clockwise, the second pressing portion 62 abuts against the first pressing portion 53 so that the abutting portion 51 contacts with the adjustable bolt 30, and the adjustable bolt 30 clamps the screwing element 86 by using the second retainer 21 to rotate the screwing element 86 clockwise. Since the third orifice 52 of the locking member 50 fits with the first coupling element 40, the abutting portion 51 contacts with the adjustable bolt 30 to clockwise rotate the screwing element 86 forcefully.

2. As illustrated in FIG. 8, after the driving notch 83 is in alignment with the third body 60, the third body 60 is revolved counterclockwise, and the second body 20 is forced by a reacting force of two opposite corners of the screwing element 86 to move, and the adjustable bolt 30 is pushed by the second body 20 and the second resilient element 73 to move, such that the distance between the first retainer 11 of the first body 10 and the second retainer 21 of the second body 20 increases, and the third body 60 does not rotate the screwing element 86 anymore, thus obtaining ratchet effect.

While the first embodiments of the invention have been set forth for the purpose of disclosure, modifications of the disclosed embodiments of the invention as well as other embodiments thereof may occur to those skilled in the art. The scope of the claims should not be limited by the first embodiments set forth in the examples, but should be given the broadest interpretation consistent with the description as a whole.

What is claimed is:

1. A movable spanner structure comprising:

a first body including a first retainer extending outwardly from one end thereof, an accommodating groove proximate to the first retainer, and a quadrangle trench defined thereon and communicating with the accommodating groove, wherein the quadrangle trench has a first face and a second face which are formed on two sides of the quadrangle trench, and between the first face and the second face is defined a first distance, the first body also includes a first orifice communicating with the quadrangle trench, and the first body includes a first cavity away from the first retainer, wherein a top surface and a bottom surface of the first cavity are closed, the one end of the first body away from the first retainer is open by ways of the first cavity, and wherein the first cavity has a third face defined on the bottom surface thereof, the first body further includes a first connecting portion passing therethrough and communicating with the first cavity and includes a second cavity communicating with the first cavity and the quadrangle trench;

a second body including a second retainer extending outwardly from one end thereof and corresponding to the first retainer of the body, the second body also including a slidable extension disposed thereon and accommodated in the accommodating groove, such that the second body moves straightly in the accommodating groove of the first body, wherein the slidable extension has a first toothed portion arranged thereon, an adjustable bolt fixed in the quadrangle trench of the first body, wherein a length of the adjustable bolt is less than the first distance, and the adjustable bolt includes a second toothed portion formed on an outer side thereof to engage with the first toothed portion of the second body, such that after the adjustable bolt is rotated, it drives the second body to move straightly in the accommodating groove of the first body, and the adjustable bolt also includes a second orifice aligning with the first orifice of the body;

a first coupling element fixed in the first orifice of the first body and the second orifice of the adjustable bolt, such that the adjustable bolt is rotatably connected with the quadrangle trench;

a locking member accommodated in the second cavity of the first body and including an abutting portion extending outwardly from a first end thereof and mounted in the second cavity, wherein the abutting portion contacts with a first end of the adjustable bolt and has a third orifice passing therethrough and aligning with the first orifice and the second orifice so that the third orifice fits with the first coupling element, and the locking member further includes a first pressing portion;

a third body disposed in the first cavity of the first body and including a second connecting portion aligning with the first connecting portion of the first body, the third body also including a second pressing portion abutting against the first pressing portion of the locking member;

a second coupling element mounted in the first connecting portion of the first body and the second connecting portion of the third body, such that the third body is rotatably coupled with the first body.

2. The movable spanner structure as claimed in claim 1, wherein the third body also includes a second receiving slot defined therein away from the second pressing portion and facing to the third face, wherein the second receiving slot is circular and accommodates a first resilient element which pushes against the third face of the first body.

3. The movable spanner structure as claimed in claim 2, wherein the first retainer has a first retaining face formed in a concave arc shape and has a plurality of first longitudinal ribs parallelly arranged thereon, and the second retainer has a second retaining face formed in a concave arc shape and has a plurality of second longitudinal ribs parallelly arranged thereon and corresponding to the plurality of first longitudinal ribs.

4. The movable spanner structure as claimed in claim 2, wherein the accommodating groove has a square opening defined on a front end thereof adjacent to the first retainer and has a circular space formed on a rear end thereof away from the square opening, and the slidable extension is formed in a rod shape and has the first toothed portion arranged thereon.

5. The movable spanner structure as claimed in claim 2, wherein the third face of the first body is a flat surface.

6. The movable spanner structure as claimed in claim 2, wherein the first connecting portion has a threaded orifice formed on one end thereof, and the second coupling element has a screwing portion for screwing with the threaded orifice.

7. The movable spanner structure as claimed in claim 2, wherein the first body also includes a through hole passing therethrough and located adjacent to a connection area of the first cavity and the second cavity; a control member is rotatably joined with the through hole of the first body and includes a rotating portion formed on a first end thereof and extending out of the first body, wherein the control member also includes a controlling portion formed on a column shape, and the controlling portion has an outer fence and a driving notch, the outer fence contacts with the third body, such that the third body does not rotate relative to the first body, and after rotating the control member, the driving notch aligns with the third body to define a rotating space in the third body, and wherein the control member also includes a fastening notch defined on a second end thereof and includes a retaining ring disposed in the fastening notch of the control member, such that the control member is mounted in the through hole by the retaining ring.

8. The movable spanner structure as claimed in claim 2, wherein the adjustable bolt also includes a first receiving slot defined on the first end thereof and aligning with the first face, wherein the adjustable bolt is columnar; and a second resilient element is fixed in the first cavity of the adjustable bolt and abuts against the adjustable bolt and the first face of the quadrangle trench.

9. The movable spanner structure as claimed in claim 2, wherein the locking member is formed in an L shape and is accommodated in the first cavity and the second cavity of the first body.

10. The movable spanner structure as claimed in claim 2, wherein the abutting portion extends into the quadrangle trench, and the first distance is greater than a total length of the adjustable bolt and the abutting portion.

11. The movable spanner structure as claimed in claim 2, wherein the first pressing portion is a tilted surface, and the second pressing portion is formed in a convex arc shape.

12. The movable spanner structure as claimed in claim 2, wherein the locking member further includes a fourth face arranged on the first end thereof and includes a fifth face formed on a second end thereof; wherein the fourth face and the fifth face are accommodated in the first cavity, and the fourth face contacts with the third face; the third body further includes a sixth face proximate to the second pressing portion and contacting with the fifth face of the locking member.

13. The movable spanner structure as claimed in claim 12, wherein the fourth face is flat or arcuate, and the fifth face is flat, such that when the fourth face is flat, it is parallel to the fifth face and the third face; and the sixth face is flat or arcuate, wherein the sixth face has an arcuate section away from the second pressing portion.

14. The movable spanner structure as claimed in claim 2, wherein the adjustable bolt further includes a third receiving slot defined on a second end thereof to accommodate a third resilient element, and the third resilient element abuts against the abutting portion of the locking member.

15. The movable spanner structure as claimed in claim 2, wherein the first pressing portion of the locking member is formed in a concave arc shape, and the second pressing portion of the third body is formed in a convex arc shape, wherein the second pressing portion is secured in the first pressing portion.

16. The movable spanner structure as claimed in claim 2, wherein the locking member is accommodated in the second cavity of the first body and is a trapezoidal protrusion, and the third body further includes a sixth face abutting against the third face of the first body.

17. The movable spanner structure as claimed in claim 2, wherein the first body further includes a first orifice, and the first orifice has inner threads arranged on an inner wall thereof, the first coupling element has outer threads arranged on an edge thereof to screw with the inner threads of the first orifice.

18. The movable spanner structure as claimed in claim 2, wherein the locking member and the third body are one piece formed.

* * * * *